US008381929B2

(12) United States Patent
Kellerer et al.

(10) Patent No.: US 8,381,929 B2
(45) Date of Patent: Feb. 26, 2013

(54) CONTAINER WITH SIDE WALLS FOLDABLE ON TOP OF ONE ANOTHER

(75) Inventors: Richard Kellerer, Feldkirchen (DE); Christian Barth, Pullach (DE)

(73) Assignee: IFCO Systems GmbH, Pullach (DE)

( * ) Notice: Subject to any disclaimer, the term of this patent is extended or adjusted under 35 U.S.C. 154(b) by 241 days.

(21) Appl. No.: 12/768,246

(22) Filed: Apr. 27, 2010

(65) Prior Publication Data

US 2011/0259884 A1 Oct. 27, 2011

(51) Int. Cl.
*B65D 8/14* (2006.01)
*B65D 6/18* (2006.01)

(52) U.S. Cl. ..... 220/7; 220/6; 206/600

(58) Field of Classification Search ..... 220/7, 6, 220/4.28, 4.01, 676, 666, 669; 206/600, 206/386; 217/14, 13, 12 R; 16/361, 357, 16/364, 362; *B65D 8/14, 6/16, 6/18*
See application file for complete search history.

(56) References Cited

U.S. PATENT DOCUMENTS

| | | | | |
|---|---|---|---|---|
| 4,735,330 | A * | 4/1988 | Hoss | 220/6 |
| 5,938,059 | A * | 8/1999 | Luburic | 220/6 |
| 6,460,717 | B1 | 10/2002 | Smyers et al. | |
| 2003/0132228 | A1 * | 7/2003 | Apps et al. | 220/6 |

* cited by examiner

*Primary Examiner* — Jacob K Ackun
*Assistant Examiner* — Robert J Hicks
(74) *Attorney, Agent, or Firm* — Warner Norcross & Judd LLP

(57) ABSTRACT

A container for transporting and storing goods with a container base and at least two side walls that can be folded over one another, the two side walls are respectively pivotably supported through at least one hinge bolt in a hinge bolt receiver, wherein the hinge bolt receiver comprises an elongated recess extending perpendicular to the container base. The folded down side wall is movable from a lower end position, in which the folded down side wall contacts the container base, into an upper end position, which is displaced upward from the lower end position in a direction perpendicular to the container base. Hinge bolt is provided with a guided translatoric movement when the side wall is folded up from the lower end position, causing rotation of the hinge bolt in the hinge bolt receiver, so that the side wall moves upward in a direction perpendicular to the container base.

24 Claims, 8 Drawing Sheets

CONTAINER WITH SIDE WALLS FOLDABLE ON TOP OF ONE ANOTHER

BACKGROUND OF THE INVENTION

The invention relates to a container for transporting and storing goods, the container including a container base and at least two side walls that can be folded on top of one another according to the preamble of patent claim 1.

Foldable containers are well known in the art. Folding containers of this type typically include a container base with a rectangular plan view, wherein the foldable side walls are linked at the edges of the base through hinges, wherein the hinges are linked through hinge bolts in hinge receivers, this means the hinges are rotatably supported.

In a folded up position of the side walls, the side walls are connected to one another through a snap lock connection, which can also be disengaged again in order to fold up the containers e.g. for empty transportation, which, however, is not mandatory.

For many folding containers the side walls are configured higher than half the width of the container base, so that the side walls overlap when two side walls disposed opposite to one another are folded towards one another. A container is known from U.S. Pat. No. 6,460,717 B1 in which the folded over side wall can be brought into two end positions, thus a lower end position in which the folded over side wall contacts the container base flush, and an upper end position in which the side wall contacts the opposite folded over side wall in a location which is offset in upward direction relative to the upper end position in a direction perpendicular from the container base in a parallel manner. The side wall can be erected from the upper end position. U.S. Pat. No. 6,460,717 B1 provides a hinge bolt receiver for this purpose which extends upward from the container base and is shaped as an arcuate slotted hole, wherein the hinge bolt is freely moveable in the hinge bolt receiver in the slotted hole when the sidewall is folded down.

It is disadvantageous for those foldable containers that the folded down side wall initially has to be lifted from its lower end position into its upper end position, in which the rotation for erecting the side wall can then be performed. When it is accidentally attempted to erect the side wall starting from its lower end position, a jamming of the hinge bolt can occur in the hinge bolt receiver, which can lead to damaging the container.

SUMMARY OF THE INVENTION

It is the object of the invention to provide a simply configured and robust folding mechanism for a container with foldable side walls, wherein the mechanism is characterized by particularly simple operation compared to known folding mechanisms.

The object is accomplished according to the invention through the features of the body patent claim 1. Advantageous embodiments of the invention are characterized by the features of the depending claims.

Thus, it is provided to configure the hinge, so that the hinge bolt is provided with a supported translatoric movement during folding the side wall up from the lower end position, this means for a rotation of the hinge bolt in the hinge bolt receiver, so that the side wall is displaced in an upward direction perpendicular to the base of the container.

The hinge bolts are thus disposed in the upper portion of the hinge bolt recess when the side wall is erected and configured to be arranged in the lower or in the upper portion of the recess when the side wall is folded down. This facilitates on the one hand side that no folding sequence is required for folding down the side walls which are disposed opposite to one another, since two end positions are provided for the folded down side wall. On the other hand it is assured that the erected side wall is always in the same position, since the movement of the hinge bolt follows a predetermined path during erecting or folding up the side wall. Jamming the hinge bolt in the lower end position is prevented, since it is forced into a translatoric movement through a rotation.

According to a preferred embodiment the hinge bolt receiver includes a recess configured as a slotted hole extending substantially in a direction perpendicular to the container base, wherein the slotted hole is configured tapered in downward direction, this means towards the base of the container and the tapered portion forms a positive guide for the hinge bolt for folding the side wall up from the lower end position.

In a particularly preferred embodiment the recess is thus defined in the tapered portion by a slanted ramp or a slanted surface oriented towards the interior of the case. The slanted ramp can thus be configured as a straight or linear surface, but also cambered, convex or concave surfaces can be provided, which extend upward from the outside of the case to the inside of the case and form a side wall of the tapered portion.

In a particularly preferred embodiment the ramp is configured straight or linear and inclined between 30° and 70°, preferably between 50° and 60°, particularly preferably inclined by 53° relative to the base surface or the container base. Namely it has become apparent that jamming the hinge bolt in the hinge bolt receiver is prevented particularly well for such angles.

According to a particularly preferred embodiment the hinge bolt has a structure which is different from a hinge bolt configured with a circular cross section, in particular a cross section with a circular or a circular segment shaped main body and a lug, which can preferably comprise a rounded lug tip or a flat area, or which comprises an oval cross section which may be provided with a flat area, or it can be configured with an eccentric cross section. The translatoric movement of the hinge bolt is provided particularly well through the structure which differs from a circular cross section.

Thus, it has become apparent that it is advantageous when the lug or the main axis of the hinge bolt is substantially oriented downward for a folded down side wall, wherein an inclination of approximately 100° relative to the base of the container or relative to a main surface of the base, in particular of 10° in a direction towards the exterior of the case is preferred.

BRIEF DESCRIPTION OF THE DRAWINGS

Further advantages and embodiments of the invention are described with reference to drawing figures, wherein.

DESCRIPTION OF THE CURRENT EMBODIMENTS

Figure 1:
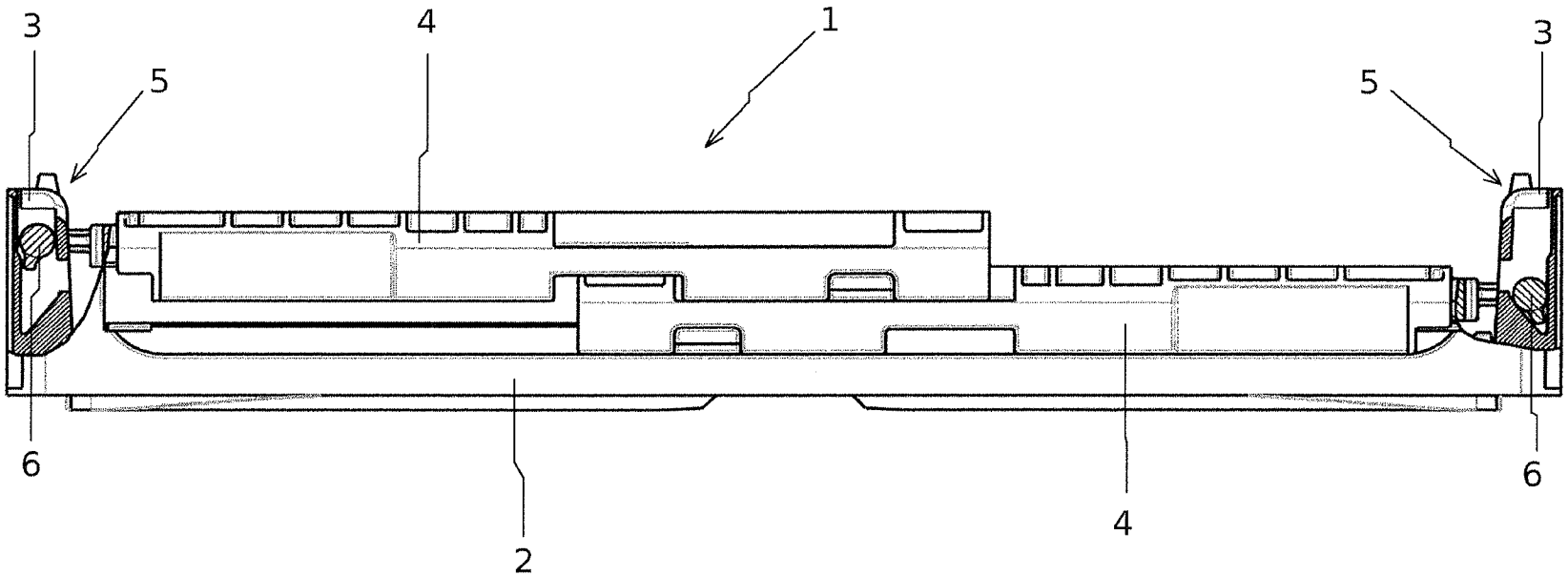
FIG. 1 illustrates a sectional view of a container with two side walls folded over one another.

The sectional views of FIGS. 1 through 6 thus extend through the line A-A FIG. 1 illustrates a container 1 with a container base 2, which includes edge bars 3 disposed opposite to one another, and with two side walls 4 folded over one another. The edge bars 3 protrude in upward direction perpendicular to a main surface of the container base 2 and can be provided in sections at the sides of the container base 2, or also in a circumferential manner. In particular, the edge bars 3 are mostly produced integral with the container base 2.

Hinge bolt receivers 5 are respectively disposed in the edge bars 3 for receiving a hinge bolt 6 disposed at a bottom side of the side wall 4. The hinge bolt receiver 5 is subsequently described in more detail with reference to FIGS. 2 through 6.

The position of the right side wall 4 illustrated in FIG. 1 is designated as the lower end position of the folded over side wall 4 and the position of the left side wall 4 is designated as the upper end position.

Figure 2:
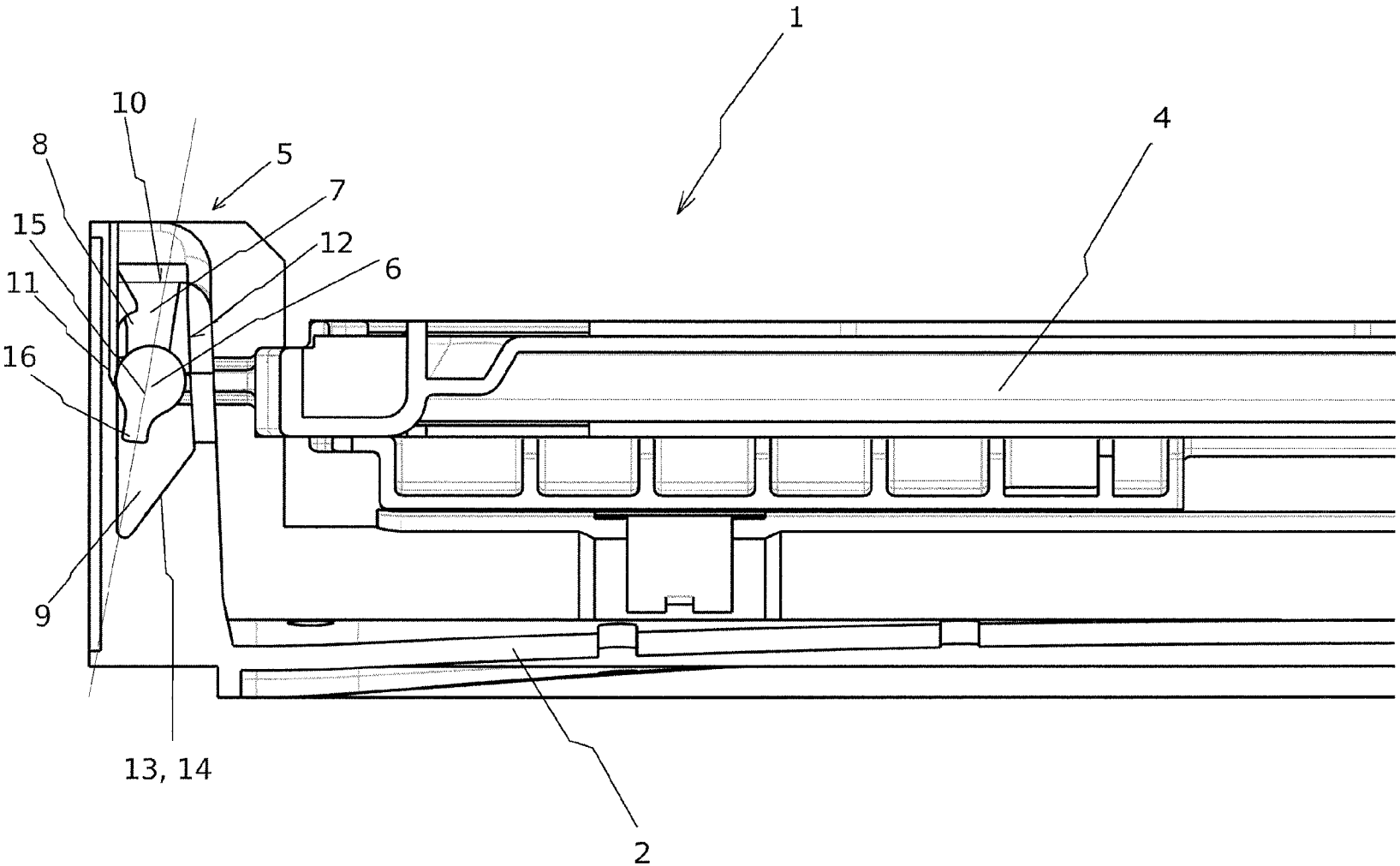
FIG. 2 illustrates an enlarged detail view of the container of FIG. 1 with a folded down side wall.

With reference to FIG. 2, the hinge bolt receiver 5 includes a recess 7 in a sectional view, the recess including an upper portion 8, which has constant width over its height, and including a lower tapered portion 9, which are configured continuous with one another, so that moving the hinge bolt 6 from the tapered portion 9 in the upper portion 8 and vice versa is possible, so that the side wall 4 can be transferred from the lower end position into the upper end position and vice versa.

The recess 7 is surrounded or defined by an upper wall 10, an outer side wall 11, an inner side wall 12 and a lower wall 13, wherein the hinge bolt 6 is moveable in the cage formed by the walls 10, 11, 12, 13.

The lower wall 13 is configured herein as a slanted ramp 14 extending from the outer side wall 11 to the inner side wall 12 in upward direction, which provides a triangular configuration in cross-section to the tapered portion 9. Thus, the slanted ramp 14 is inclined by 53° relative to the base of the container.

Figure 6:
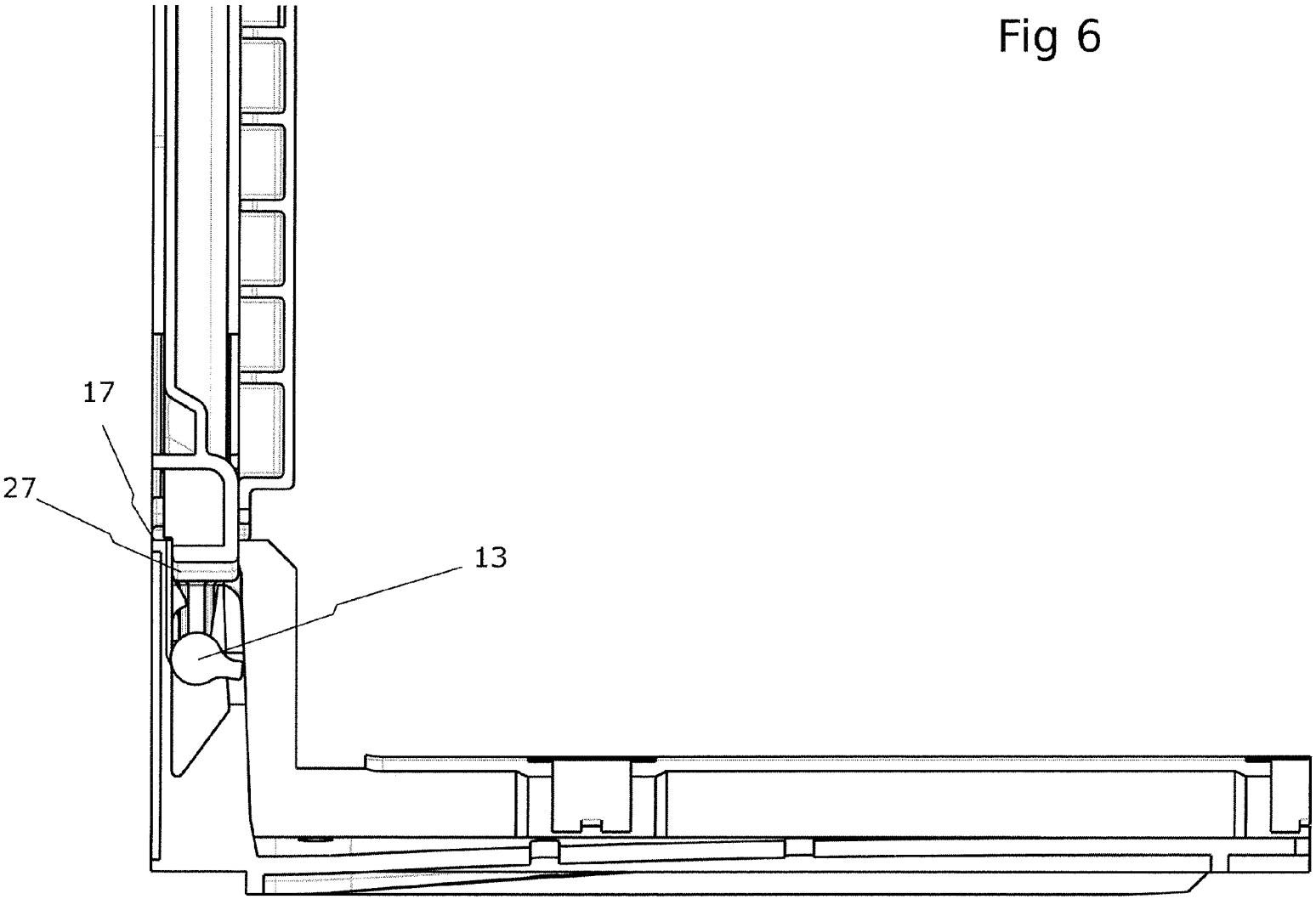
FIG. 6 illustrates a sectional view of a portion of a container with a side wall folded up.

The hinge bolt 6 comprises a main body 15 with a circular shape in cross-section and a protruding lug 16. When the side wall 4 is folded down, the lug 16 faces substantially downwards, as illustrated in FIG. 2, thus towards the container base 2, and when the side wall 4 is folded up, as illustrated in FIG. 6, the lug substantially faces towards the inside of the container. More specifically, in the folded down position of the side walls 4, the lug is inclined by approximately 100° relative to the container base 2, namely 10° in the direction towards the exterior of the case.

When the side walls are folded down, the hinge bolt 6, coming from the upper end position of the side wall 4 illustrated in FIG. 2, is moveable into the tapered portion 9 of the hinge bolt receiver, wherein the circular shaped main body 15 touches the slanted ramp 14 with the lug 16 of the hinge bolt 6 in the lower end position. In the lower end position, the circular shaped main body 15 of the hinge bolt 6 furthermore contacts the outer side wall 11 of the hinge bolt receiver 5, whereby the side wall 4 is supported without clearance, in particular as described in FIG. 1.

The folding process of side wall 4 is described with reference to FIGS. 3 through 6. When folding side wall 4, the sidewall performs a rotating movement about a rotation center 17, which is located substantially in the center of the hinge bolt 6. The configuration of the hinge causes a translatoric movement of the rotation center when a rotating movement is performed starting at the lower end position of the side wall 4, wherein the translatoric movement displaces the side wall 4 upward when it is being folding up.

More precisely the slanted ramp 14 with the outer side wall 11 of the recess 7 forms a positive guide for the hinge bolt 6 when the side wall 4 is folded up, wherein the circular main body 15 rolls up on the outer side wall 11 and the lug 16 slides up on the slanted ramp 14.

Figure 3:
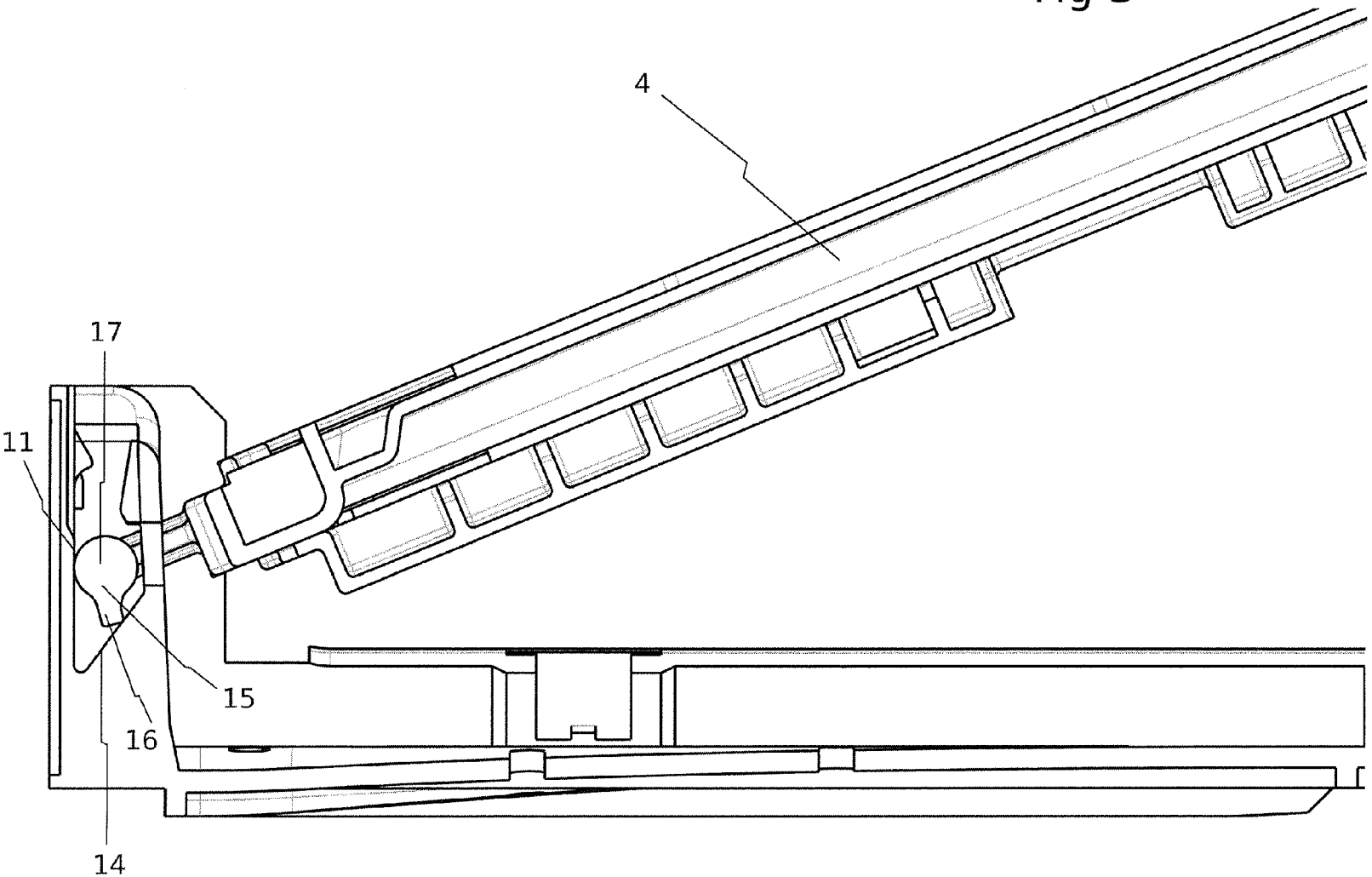
FIG. 3 illustrates a sectional view of a portion of a container with a side wall folded up by approximately 30°.
Figure 4:
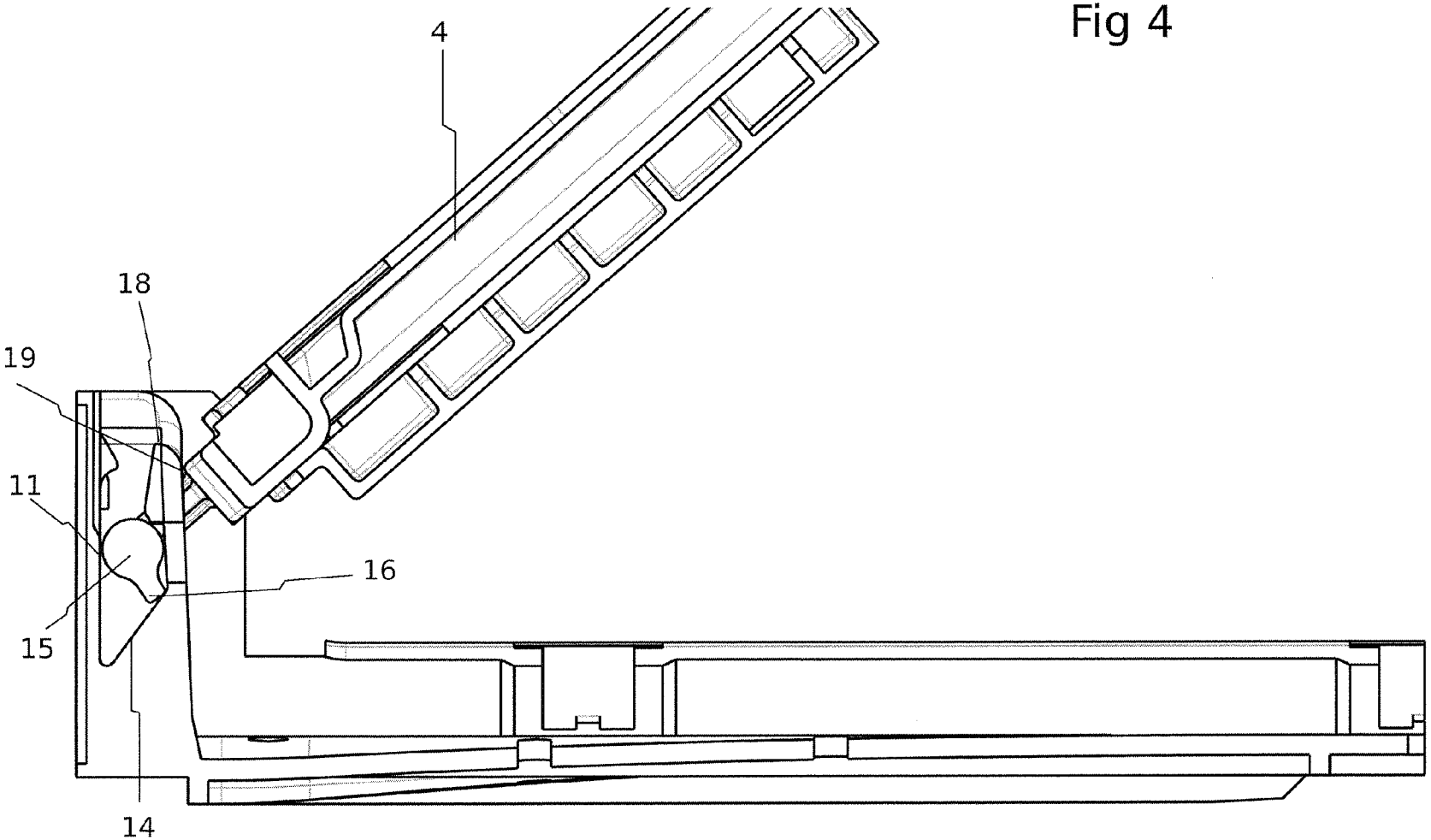
FIG. 4 illustrates a sectional view of a portion of a container with a side wall folded up by approximately 45°.
Figure 5:
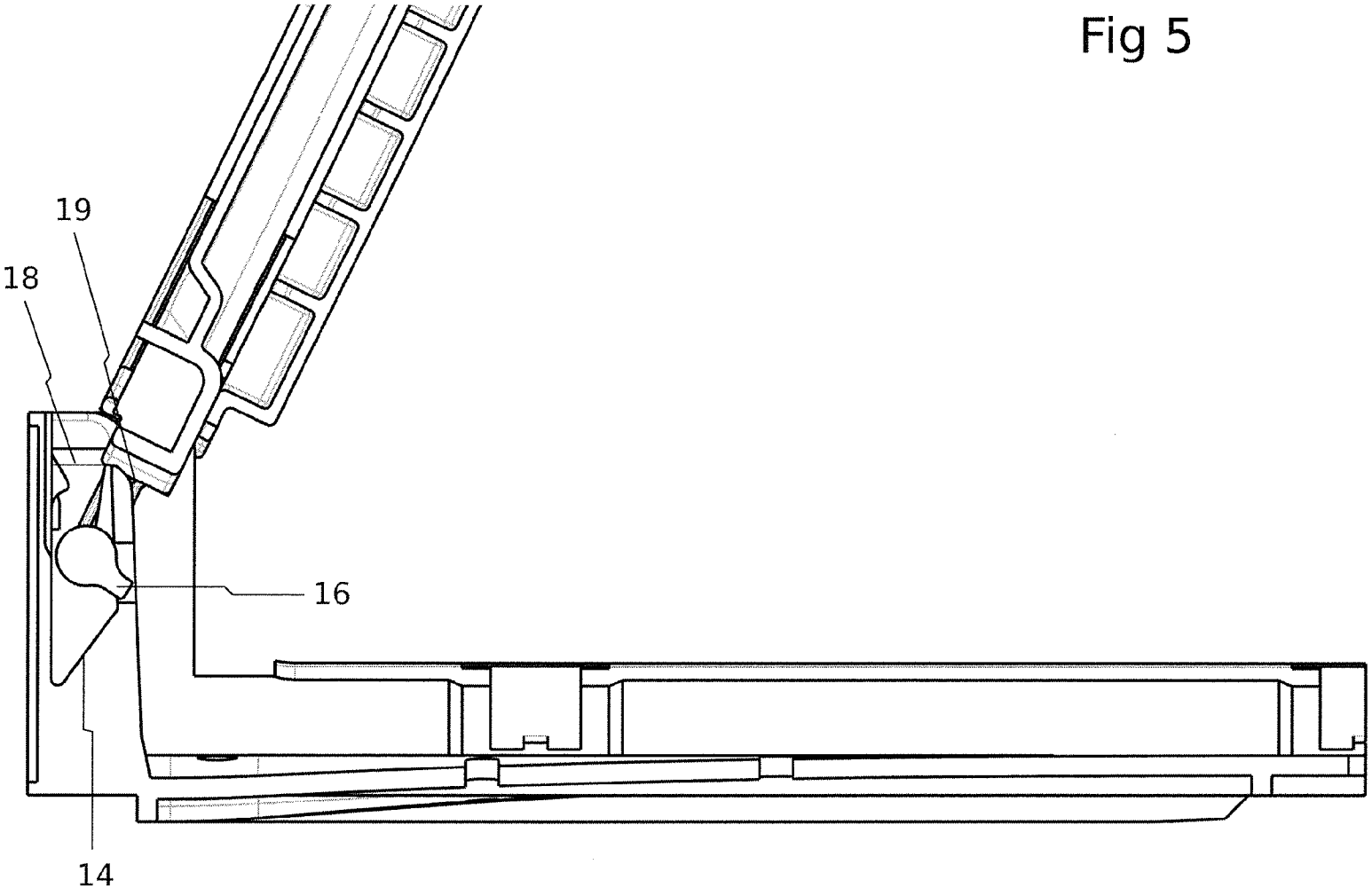
FIG. 5 illustrates a sectional view of a portion of a container with a side wall folded up by approximately 60°.

FIG. 3 illustrates a side wall 4 which is folded up at an angle of approximately 30°, wherein the lug 16 of the hinge bolt 6 contacts the slanted ramp 14 and the circular-shaped main body 15 of the hinge bolt 6 contacts the outer side wall 11 of the recess 7. FIGS. 4 and 5 illustrate respective settings at 45° and 60°, which makes the positive guide for the hinge bolt 6 evident.

The positive guide for the lug 16 terminates approximately at the slanted ramp 14, as illustrated in FIG. 4 where the side wall 4 is folded up at an angle of 45°. The side wall 4 is extended at a shoulder 18, as described in FIGS. 5 and 6, wherein a portion of the lower edge 19 of the main surface of the side wall 4 contacts the shoulder 18. The rotation of the side wall 4 is limited by a stop element 27 which is disposed at the side wall 4, wherein the stop element hits the edge bar 3 when the side wall 4 is folded up.

Figure 7:
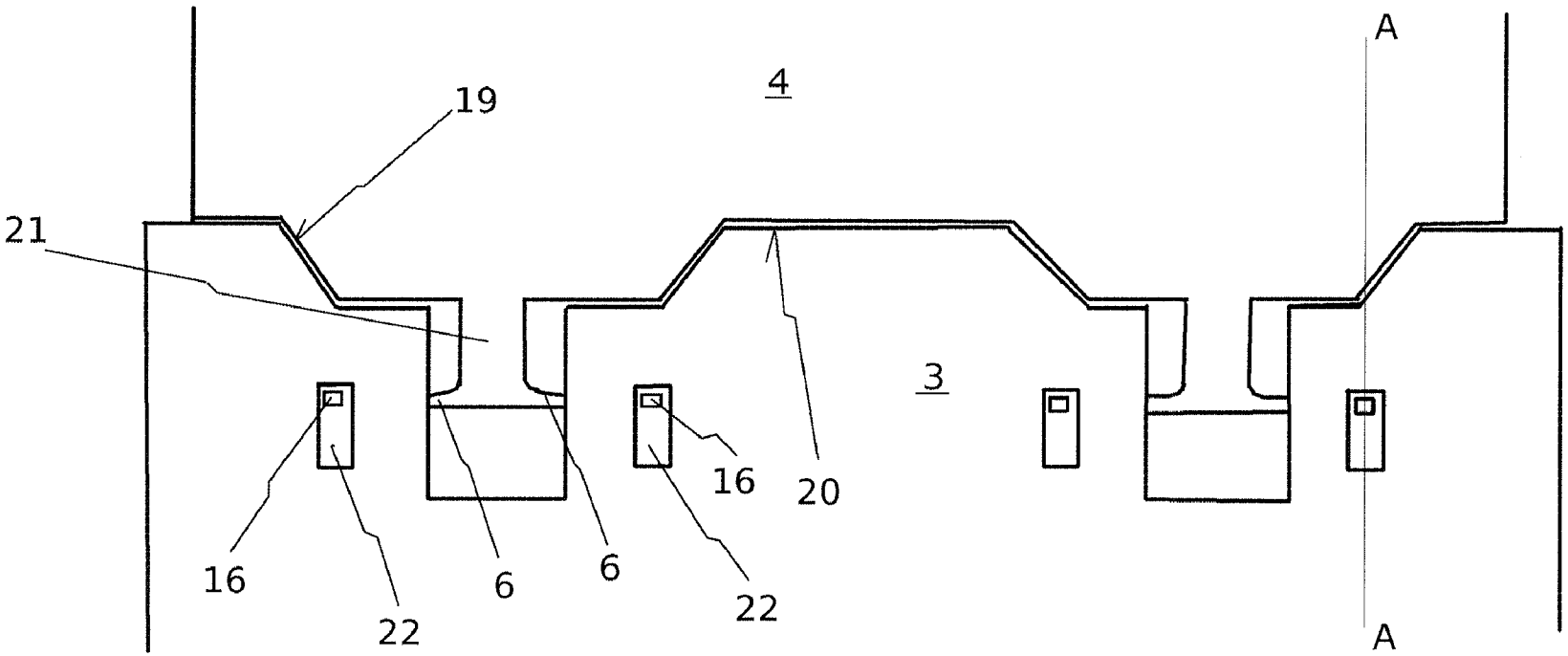
FIG. 7 illustrates a side view of a container with a side wall folded up.

FIG. 7 illustrates a side view of the folded up side wall 4 from inner side of the case. Thus, the lower edge 19 of the side wall 4 contacts the upper edge 20 of the edge bar 3. In this embodiment the side wall 4 is linked through two hinges, wherein, however this does not constitute a limitation. It is furthermore described that the hinge bolts 6 are disposed on both sides of a protrusion 21 in the lower portion of the side wall 4. The hinge bolts 6 comprise lugs 16 at their ends, wherein the lugs are oriented towards the interior of the case, hence they are oriented out of the drawing plane. The four lugs 16 thus illustrated respectively engage the positioning recesses 21, which are located on an inside of the edge bar 3, wherein the lugs act as positioning elements, so that lifting the side wall 4 off relative to the container base 2 is prevented.

Figure 8A:
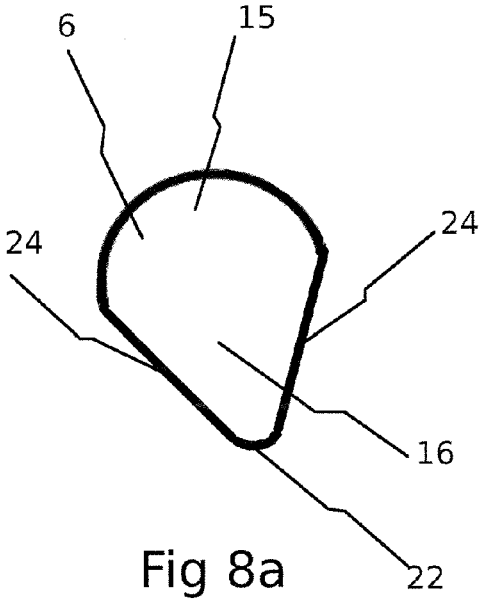
FIG. 8*a, b, c, d* illustrate sectional views of hinge bolts.
Figure 8B:
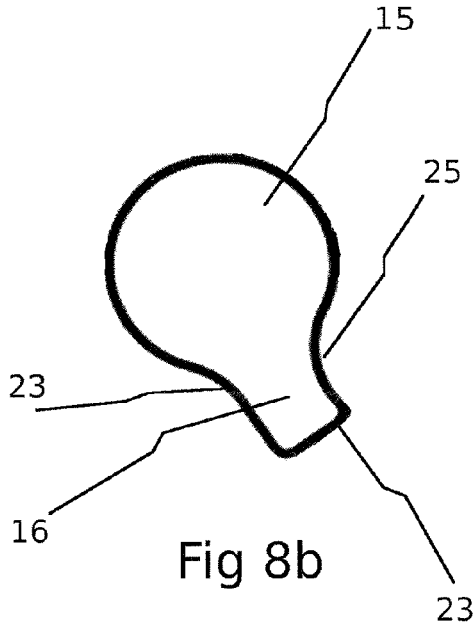
Figure 8D:
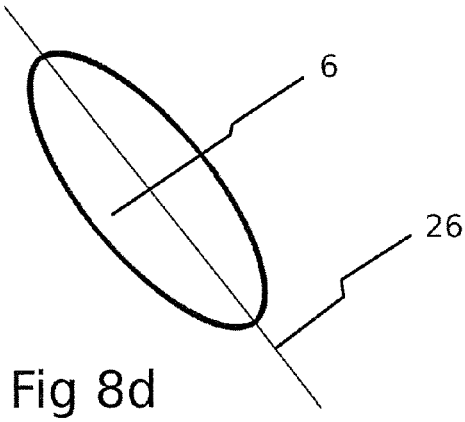
Figure 8C:
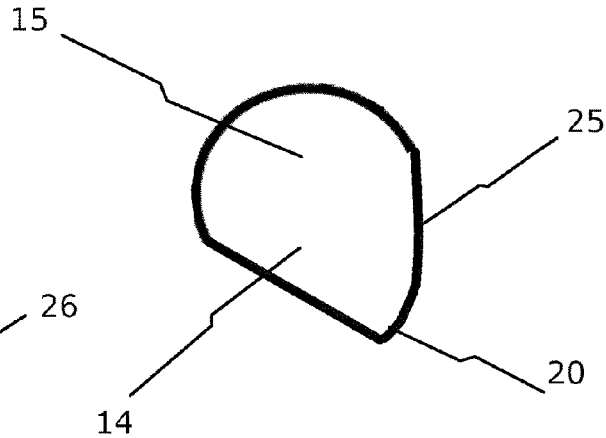

FIGS. 8*a*, 8*b*, 8*c* and 8*d* illustrate different embodiments of the hinge bolt 6. Corresponding to the embodiments of FIGS. 8*a*, 8*b* and 8*c*, the hinge bolt 6 includes a circular shaped or circular segment shaped main body 15 and a protruding lug portion 16. The lug 16 can include a preferably rounded point 22 or a preferably planar flat area 23, wherein the lug walls 24, as illustrated in FIGS. 8*a* and 8*c*, can be linear or can also include cambers, as designated in FIGS. 8*b* and 8*c* with the reference numeral 25.

FIG. 8*d* illustrates a hinge bolt 6 with an oval cross section, which includes a main axis 26, which defines a direction in a plane like the lugs 16.

Reinforced portions can certainly be attached or molded on in particular on the surfaces of the hinge bolts 6, which surfaces are in contact with the slanted ramp 14 of the hinge bolt receiver (5), hence the portion slide up on the ramp, which can increase the service life of the foldable container.

The invention claimed is:

1. A container for transporting and storing goods with a container base (2) and at least two side walls (4) that can be folded over one another, wherein the at least two side walls (4) that can be folded over one another are respectively pivotably supported through at least one hinge bolt (6) in a hinge bolt receiver (5), wherein the hinge bolt receiver (5) comprises an elongated recess (7), which extends in a direction perpendicular to the container base (2), wherein at least one of the at least two side walls when folded down (4) is movable from a lower end position, in which the folded down side wall contacts the container base (2), into an upper end position, which is displaced upward from the lower end position in a direction perpendicular to the container base (2), wherein the hinge bolt (6) is provided with a guided translatoric movement when the side wall (4) is folded up from the lower end position, so that the side wall (4) moves upward in a direction perpendicular to the container base (2), wherein the recess (7) is tapered in a downward direction and the tapered portion of the recess (7) forms a positive guide for the hinge bolt (6) when the side wall (4) is folded up from the lower end position.

2. A container for transporting and storing goods with a container base (2) and at least two side walls (4) that can be folded over one another, wherein the at least two side walls (4) that can be folded over one another are respectively pivotably supported through at least one hinge bolt (6) in a hinge bolt receiver (5), wherein the hinge bolt receiver (5) comprises an elongated recess (7), which extends in a direction perpendicular to the container base (2), wherein at least one of the at least two side walls when folded down (4) is movable from a lower end position, in which the folded down side wall contacts the container base (2), into an upper end position, which is displaced upward from the lower end position in a direction perpendicular to the container base (2), wherein the hinge bolt (6) is provided with a guided translatoric movement when the side wall (4) is folded up from the lower end position, so that the side wall (4) moves upward in a direction perpendicular to the container base (2), wherein the recess (7) is tapered in a downward direction, wherein the tapered portion of the recess (7) is defined by a slanted ramp (14) inclined by 30° to 70°.

3. A container for transporting and storing goods with a container base (2) and at least two side walls (4) that can be folded over one another, wherein the at least two side walls (4) that can be folded over one another are respectively pivotably supported through at least one hinge bolt (6) in a hinge bolt receiver (5), wherein the hinge bolt receiver (5) comprises an elongated recess (7), which extends in a direction perpendicular to the container base (2), wherein at least one of the at least two side walls when folded down (4) is movable from a lower end position, in which the folded down side wall contacts the container base (2), into an upper end position, which is displaced upward from the lower end position in a direction perpendicular to the container base (2), wherein the hinge bolt (6) is provided with a guided translatoric movement when the side wall (4) is folded up from the lower end position, so that the side wall (4) moves upward in a direction perpendicular to the container base (2), wherein the recess (7) is tapered in a downward direction and wherein the tapered portion of the recess (7) is defined by a slanted ramp (14), wherein the slanted ramp (14) extends upward from an outer side wall (11) of the recess (7) to an inner side wall (12) of the recess (7).

4. The container according to claim 1, wherein the hinge bolt (6) comprises a cross-section with a circular or circular segment shaped main body (15) and a lug (16), which can comprise a point (22) or a flat area (23), or the hinge bolt comprises an oval cross-section or an eccentric shape.

5. The container according to claim 4, wherein the lug (16) or the main axis (26) of the hinge bolt (6) is oriented substantially in a direction toward the container base (2) when the side wall (4) is folded down.

6. The container according to claim 1, wherein the hinge bolt (6) is disposed in an upper portion (8) of the recess (7) when the side wall is folded up.

7. The container according to claim 1, wherein the side wall (4) comprises stop elements (27), which limit the rotation of the side wall (4).

8. The container according to claim 1, wherein a lug (16) engages a positioning recess (21) when the side wall (4) is folded up, so that lifting the side wall (4) off relative to the container base (2) is prevented.

9. The container according to claim 1, wherein the tapered portion of the recess (7) is defined by a slanted ramp inclined by 50° to 60°.

10. The container according to claim 9, wherein the slanted ramp (14) extends upward from an outer side wall (11) of the recess (7) to an inner side wall (12) of the recess (7).

11. The container according to claim 1, wherein the tapered portion of the recess (7) is defined by a slanted ramp inclined by 53°.

12. The container according to claim 9, wherein the slanted ramp (14) extends upward from an outer side wall (11) of the recess (7) to an inner side wall (12) of the recess (7).

13. The container according to claim 1, wherein the tapered portion of the recess (7) is defined by a slanted ramp (14) inclined by 30° to 70°.

14. The container according to claim 13, wherein the slanted ramp (14) extends upward from an outer side wall (11) of the recess (7) to an inner side wall (12) of the recess (7).

15. The container according to claim 2, wherein the hinge bolt (6) comprises a cross-section with a circular or circular segment shaped main body (15) and a lug (16), which can comprise a point (22) or a flat area (23), or the hinge bolt comprises an oval cross-section or an eccentric shape.

16. The container according to claim 15, wherein the lug (16) or the main axis (26) of the hinge bolt (6) is oriented substantially in a direction toward the container base (2) when the side wall (4) is folded down.

17. The container according to claim 2, wherein the hinge bolt (6) is disposed in an upper portion (8) of the recess (7) when the side wall is folded up.

18. The container according to claim 2, wherein the side wall (4) comprises stop elements (27), which limit the rotation of the side wall (4).

19. The container according to claim 2, wherein a lug (16) engages a positioning recess (21) when the side wall (4) is folded up, so that lifting the side wall (4) off relative to the container base (2) is prevented.

20. The container according to claim 3, wherein the hinge bolt (6) comprises a cross-section with a circular or circular segment shaped main body (15) and a lug (16), which can comprise a point (22) or a flat area (23), or the hinge bolt comprises an oval cross-section or an eccentric shape.

21. The container according to claim 20, wherein the lug (16) or the main axis (26) of the hinge bolt (6) is oriented substantially in a direction toward the container base (2) when the side wall (4) is folded down.

22. The container according to claim 3, wherein the hinge bolt (6) is disposed in an upper portion (8) of the recess (7) when the side wall is folded up.

23. The container according to claim 3, wherein the side wall (4) comprises stop elements (27), which limit the rotation of the side wall (4).

24. The container according to claim 3, wherein a lug (16) engages a positioning recess (21) when the side wall (4) is folded up, so that lifting the side wall (4) off relative to the container base (2) is prevented.

* * * * *